US008061519B2

(12) United States Patent
Taglione

(10) Patent No.: US 8,061,519 B2
(45) Date of Patent: Nov. 22, 2011

(54) SLEEVE FOR CONTAINERS

(75) Inventor: Stephen Joseph Taglione, Tarrytown, NY (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 12/716,807

(22) Filed: Mar. 3, 2010

(65) Prior Publication Data

US 2011/0215015 A1 Sep. 8, 2011

(51) Int. Cl.
*B65D 75/00* (2006.01)
*B65B 43/00* (2006.01)

(52) U.S. Cl. ..... 206/430; 53/452; 206/153; 206/158; 206/434

(58) Field of Classification Search ..... 206/153–158, 206/194, 427, 429, 430, 434; 53/452; 294/87.2
See application file for complete search history.

(56) References Cited

U.S. PATENT DOCUMENTS 3,561,594 A * 2/1971 Jorgensen ..... 206/430
3,926,307 A * 12/1975 Klygis ..... 206/153
4,326,628 A * 4/1982 Wood ..... 206/158
4,570,795 A * 2/1986 Fernandez Sanz ..... 206/430
5,267,644 A * 12/1993 Tsao ..... 206/158
5,682,982 A * 11/1997 Stonehouse ..... 53/452
5,845,776 A * 12/1998 Galbierz et al. ..... 206/427
5,921,392 A * 7/1999 Davis ..... 206/434
6,168,012 B1 * 1/2001 Galbierz ..... 206/153
6,926,147 B2 * 8/2005 Holley, Jr. ..... 206/434

* cited by examiner

*Primary Examiner* — Bryon Gehman
(74) *Attorney, Agent, or Firm* — Fitch, Even, Tabin & Flannery

(57) ABSTRACT

A sleeve for storing and permitting removal of containers having an outwardly extending upper flange includes a bottom panel with a pair of side edges, each connecting to a side panel, and a top panel that extends between the side panels. The bottom panel includes at least one opening spaced from the side edges. The opening is sized smaller than the flange, but large enough to permit the container to extend partially therethrough so that the bottom panel supports the flange. One or more slits can extend generally outward from the opening and are spaced from the side edges. The slits are configured to increase the size of the opening so that the flange can pass therethrough, allowing the container to be removed. The opening then at least partially returns to its initial size, so that a container subsequently received in the opening is supported by the bottom panel.

17 Claims, 3 Drawing Sheets

SLEEVE FOR CONTAINERS

FIELD

This disclosure relates to a sleeve for containers, and in particular a sleeve for storing multiple containers and permitting selective removal of individual containers.

BACKGROUND

In the field of food packaging, it is well known to provide cartons or packaging systems for carrying several smaller containers at once. The packaging system may be in the form of a sleeve containing multiple smaller containers. Often the smaller containers hold any of a variety of food or beverage items. One type of smaller container is a cup with a lid. An example sleeve is described in U.S. Pat. No. 4,570,795 which illustrates a sleeve containing two stacked rows of containers. The containers, however, are difficult to remove without destroying the sleeve. For example, removing a container from the bottom row can result in tearing of the sleeve, and can render the sleeve unusable for storing remaining containers.

One prior packaging system using a sleeve is configured to permit improved removal of a desired container. U.S. Pat. No. 6,926,147 describes a sleeve to hold a number of containers. Frangible portions are provided in fold lines adjacent openings in the bottom of the sleeve. The openings extend to the fold lines. When a user wants to remove a cup from the bottom row of the sleeve, the frangible portion can be broken along the fold line to increase the size of the opening to allow the cup to be pulled sideways and removed from the sleeve. Disadvantageously, once the frangible portion has been broken the sleeve is weakened and a cup positioned above the removed cup that subsequently drops into the opening may not be properly restrained from also exiting the sleeve laterally. Additionally, fold lines are usually inherently weak structurally, so a tear along a fold as provided by the frangible portions can have a propensity to continue tearing, and can result in a sleeve unsuitable for storing the remainder of the cups and/or permitting proper dispensing

SUMMARY

In one form, a multi-panel sleeve is provided for storing and selectively permitting removal a plurality of containers. The containers include an upper flange that extends outwardly from the container body and the sleeve includes features that utilize the flanges to retain the containers within the sleeve. The sleeve includes a bottom panel with a pair of longitudinal side edges, a pair of side panels, each connected to a longitudinal side edge of the bottom panel, and a top panel that extends between the side panels. The sleeve also includes at least one opening disposed within the bottom panel and spaced from the longitudinal side edges. The at least one opening is first sized smaller than the upper flange of the containers while also big enough to permit the container to extend partially therethrough so that the upper flange or another enlarged portion of the container, such as a shoulder or step, rests on and is supported by the bottom panel. At least one slit, and preferably two or more slits, is provided adjacent to the at least one opening. The slit or slits extend generally outward from the opening, but are spaced from the longitudinal side edges of the bottom panel. The slit or slits are configured to increase the opening to a size where the upper flange or enlarged portion of the container can pass therethrough, allowing removal of the container while also preserving the structural integrity of the sleeve. The configuration and positioning of the slit or slits may also permit the surrounding portions of the opening to at least partially return toward their original positions so that a container subsequently received in the opening can be supported by the bottom panel. This advantageously allows a container to be removed from the sleeve without compromising the structural integrity of the sleeve for holding the remaining containers.

BRIEF DESCRIPTION OF THE DRAWINGS

FIG. 1 is a perspective view of an assembled sleeve enclosing containers;

DETAILED DESCRIPTION

Figure 2:
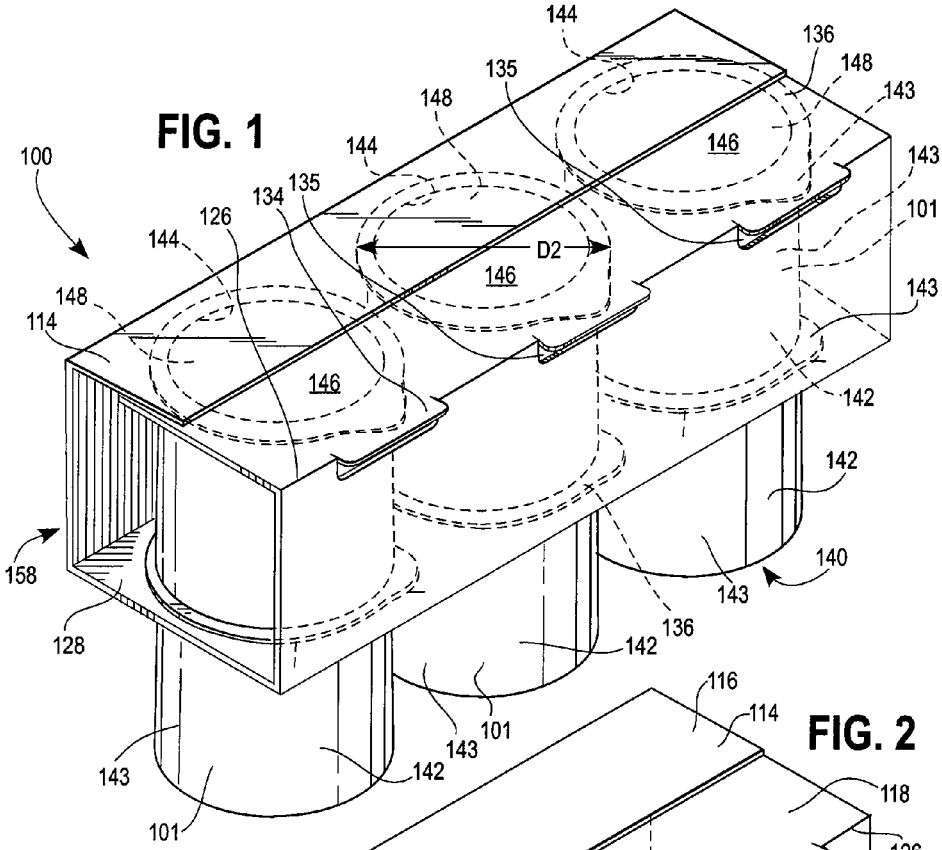
FIG. 2 is a perspective view of the sleeve of FIG. 1 showing an empty configuration and openings with relief slits on a bottom panel thereof.

A sleeve 100 is disclosed herein that both retains multiple containers 101 and allows a user to selectively remove individual containers 101 without destroying the structural integrity of the packaging sleeve 100, so that remaining containers 101 can be stored and removed from the sleeve 100.

The sleeve 100 is configured to store two rows of containers 101, each having an upper flange 136, in a stacked relation where the sleeve 100 includes features configured to retain the containers 101 by at least the upper flange 136. The sleeve 100 includes a bottom panel 128 having at least one opening 138 defined therein. The bottom panel 128 is connected to a top panel 114 using side panels 120, 124 spanning between edge portions 112 of the top and bottom panels. A bottom row 156 of containers 101 is retained in the openings 138, such that a body 143 of the container 101 protrudes through the opening 138 while the upper flange 136 of the container 101 rests and is supported by the bottom panel 128 adjacent the opening 138. After the top row 158 of containers 101 is stacked on top of the bottom row 156, the sleeve 100 is folded about the containers 101 to store and retain them therein. The sleeve 100 includes slots 135 along an upper edge that are configured to partially receive the upper flanges 136 of the top row of containers 101 to restrain the top row 158 within the sleeve 100. To facilitate removal, as well as preserve the structural integrity of the sleeve 100 while containers 101 are sequentially removed, one or more slits 150 are provided adjacent each opening 138. The slits 150 are configured to increase the size of the openings 138, such as to a size where the upper flange 136 of a container 101 can pass therethrough, which allows the container 101 to be removed through the bottom panel 128. As the container 101 in the bottom row 156 is removed, a container 101 in the top row 158 is then permitted to fall into the vacated opening 138. Advantageously, the slits 15 are positioned and sized such the bottom panel 128 retains the support structure and strength necessary to support a subsequent container 101 from falling through the opening 138 without manipulation.

Referring to FIG. 1, the sleeve 100 is configured to hold and permit selective removal of the cups or containers 101, such as cups or containers storing food products. As illustrated in the exemplary embodiment, each container 101 includes a base 140 and a sidewall 142 extending upwardly therefrom. The sidewall 142 forms the container body 143 taking any suitable shape, such as generally box-shaped, cylindrical, frusto-conical, or the like. The sidewall 142 terminates at the outwardly extending flange 136 positioned on an opposite end of the sidewall 142 from the base 140. The flange 136 may also include an outwardly projecting tab 145, which can be utilized to retain the container 101 within the sleeve 100, such as on a top row 158, or aid a user in opening the container 101. The flange 136 also defines a mouth 144 that provides access to an interior 146 of the container 101. By one approach, the mouth 144 and the flange 136 are covered by a film or web 148 which can be configured to seal the interior 146 of the container 101, such as to store a food product or the like.

The bottom panel 128 defines the apertures or openings 138 therein, such as transversely aligned across the bottom panel 128 between side edges 108 of the sleeve 100. Preferably, the openings 138 are sized to receive and hold at least a portion of the containers 101, as shown in FIG. 1. As illustrated, the openings 138 are generally circular, however, other suitable shapes can be utilized, such as generally square, rectangular, triangular, or the like. Accordingly, references described herein as limited to degrees have equal applicability to these other shapes. A diameter or width D1 of the openings 138 is sized, such that the opening 138 can receive the sidewall 142 of the container 101 therethrough while also being less than a diameter or width D2 of the flange 136 so that the flange 136 can at least partially rest on and be supported by the bottom panel 128 adjacent the openings 138. In one example, the diameter D1 of the openings 138 is about 2.46 inches and the diameter D2 of the flange 136 is about 2.74 inches.

By one approach, the relief slits 150 are provided adjacent to each of the openings 138 which are configured to allow one of the containers 101 to be withdrawn from the sleeve 100 through the bottom panel 128. By this approach, the relief slits 150 allow a user to remove one of the containers 101 through the bottom panel 128 without damaging the structural integrity of sleeve 100, without causing the removal of unchosen containers 101, and/or while maintaining support structure for a subsequent one of the containers 101 received in the opening 138. The relief slits 150 achieve this result by increasing the size of the openings 138 such that the flange 136 of the containers 101 can fit through the openings 138. The opening 138 may return at least partially to its original size such that the flange 138 of a subsequent container 101 received in the opening 138 can rest on and be supported by the bottom panel 128. As illustrated, the relief slits 150 extend generally radially from an edge 152 of the opening 138. Preferably, though not necessarily, the relief slits 150 are slightly spaced by a bridge 154 of material, such as within the range of 0.01 inch to 0.05 inch, and more preferably 0.03 inch. This bridge 154 can be broken during initial removal of a container 101 from the sleeve 100.

Figure 3:
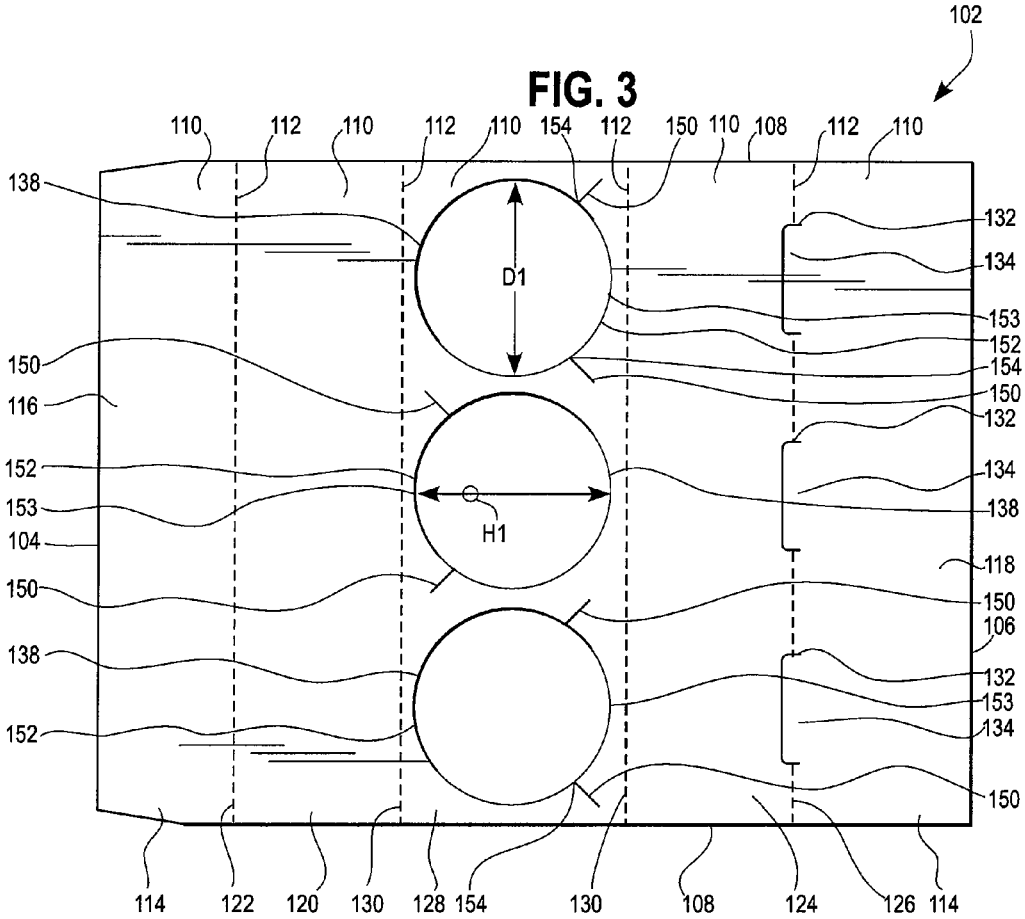
FIG. 3 is a top plan view of a sleeve blank showing a bottom panel with openings and relief slits.

As illustrated in FIGS. 2 and 3, the bottom panel 128 includes two relief slits 150 adjacent each opening 138. By one approach, the slits 150 are spaced symmetrically about a horizontal axis H1 of each opening 138. By another approach, the slits 150 are spaced from one another by a range of 35 degrees to 145 degrees, and preferably by a range of 70 degrees to 110 degrees.

In one form, the slits 150 of adjacent openings 138 are located on opposite sides of the bottom panel 128. As illustrated, the openings 138 are generally circular and the slits 150 are all spaced 180 degrees or less from one another. This slit positioning advantageously provides greater structural integrity during use of the sleeve 100 and subsequent removal of the containers 101 by distributing the slits 150 to both sides of the bottom panel 128, preferably in an alternating pattern. This positioning also prevents the slits 150 from being generally collinear across the bottom panel 128.

In the illustrated form, the openings 138 are generally circular and a midpoint 153 of the edge 152 between the slits 150 is positioned closest to the adjacent fold line 112. Additionally, the slits 150 do not extend substantially past a tangential line drawn at the midpoint 153 of the edge 152, and preferably the slits 150 are on an opposite side from the tangential line than the adjacent fold line 112. In this form, the relief slits 150 can extend radially or outwardly away from the openings 138 for a length in a range of 0.25 inch to 0.5 inch, and preferably 0.375 inch, but necessarily depends on the diameter or width of the flange 136, which in this form is about 2.74 with a thickness of about 0.32 inches. In one example, the preferred diameter D1 of the openings 138 is about 2.46 inches, and the preferred length of relief slits 150 is about 0.375 inch. Thus, in this example, the desired ratio of relief slit length to opening diameter is about 1:6.5 where two relief slits 150 are utilized.

Figure 4:
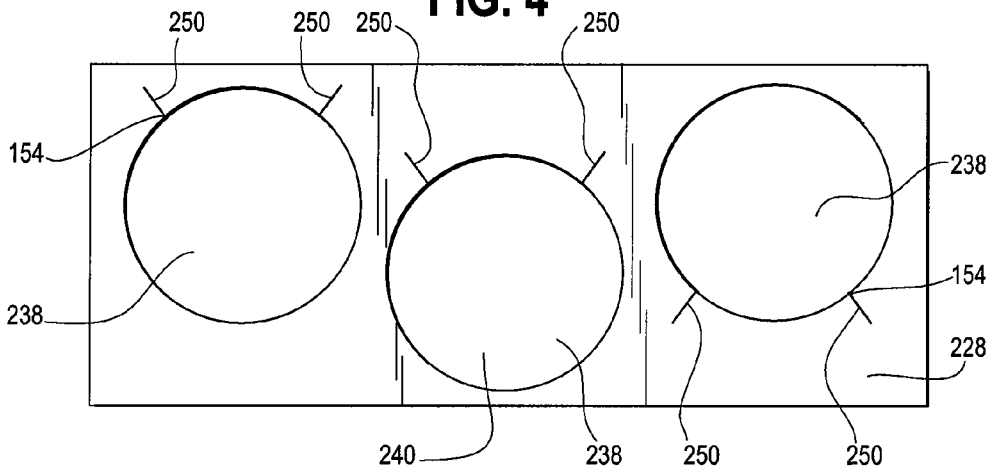
FIG. 4 is a top plan view of an alternative bottom panel for the sleeve of FIG. 1 showing openings and relief slits.
Figure 5:
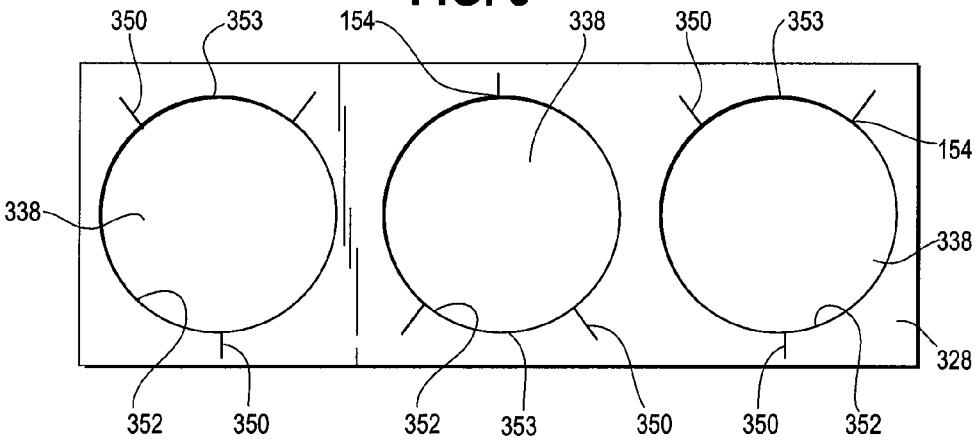
FIG. 5 is a top plan view of an alternative bottom panel for the sleeve of FIG. 1 showing openings and relief slits.
Figure 6:
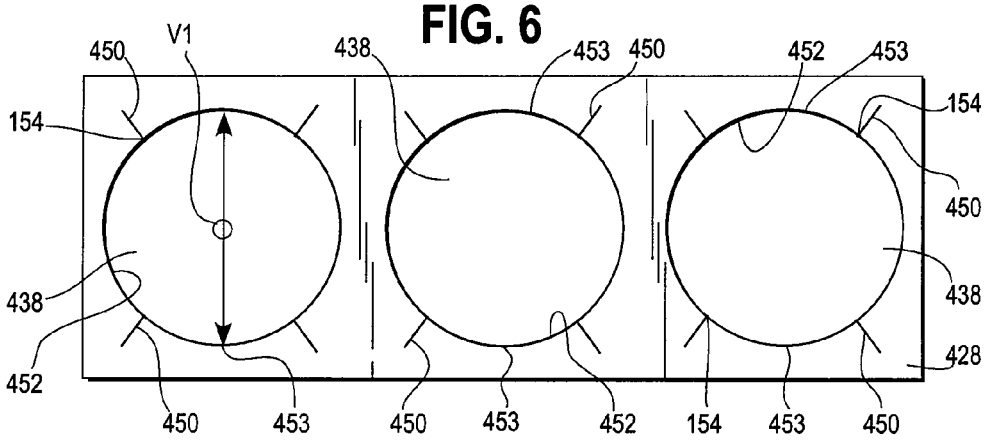
FIG. 6 is a top plan view of an alternative bottom panel for the sleeve of FIG. 1 showing openings and relief slits.

In the exemplary embodiment discussed above, there are two relief slits 150 positioned adjacent three of the openings 138, however, the sleeve 100 could alternatively have a different number of openings 138 or openings 138 in differing patterns or differing patterns for the relief slits 150, examples of which are shown in FIGS. 4-6.

As illustrated in FIG. 4, an alternative bottom panel 228 for the sleeve 100 includes three openings 238 where one opening 240 is offset from the other two openings 238. In this form, two relief slits 250 are positioned adjacent each opening 238 as described above, however, due to the offset opening 240, adjacent openings 238 can have the relief slits 250 positioned on the same side, with the remaining opening 238 having the relief slits 250 on the opposite side of the bottom panel 228 as compared to the other two openings 238. Alternatively, the three openings 238 can each have the relief slits 250 positioned on the same side. In one example, the relief slits 250 are configured within the ranges and the positioning discussed above with respect to the slits 150. This positioning also advantageously prevents the slits 250 from being generally collinear across the bottom panel 228.

Another alternative form of a bottom panel 328 for the sleeve 100 is shown in FIG. 5. In this form, the bottom panel 328 includes three openings 338, but can include other numbers of openings 338, as discussed above. Each opening 338 includes three relief slits 350 extending generally radially therefrom, such as discussed above. As illustrated, the relief slits 350 are positioned around the opening 338, such as spaced from one another by 120 degrees, with a tolerance of 10 degrees in either direction. In this form, the patterns of the relief slits 350 extending from the openings 338 in the two outer positions are substantially similar with a midpoint 353 between two relief slits 350 on an edge 352 of the openings 338 positioned closest to the adjacent fold line 112. The pattern of the relief slit 350 of the relief slits 350 extending from the opening 338 in the middle position is advantageously a mirror image of the outer positions, which distributes the relief slits 350 more evenly across the bottom panel 328. As a result of including an additional relief slit 350 in contrast to the examples discussed above, the relief slits 350 can have a shorter length. In one example form, the relief slits 350 have a length in the range of about 0.0625 inch to about 0.156 inch, and preferably about 0.125 inch.

In yet another form, an alternative bottom panel 428 for the sleeve 100 is shown in FIG. 6. In this form, the bottom panel 428 includes three openings 438 and four relief slits 450 extending generally radially away from each opening 438, as discussed above. As illustrated, the relief slits 450 are positioned generally symmetrically about the horizontal axis H1 and a vertical axis V1 of each opening 438 and are spaced from each other by about 90 degrees with a tolerance of 10 degrees in either direction. In one form, a midpoint 453 between adjacent relief slits 450 along an edge 452 of the openings 438 is closest to the adjacent fold line 112. The benefit from including the four relief slits 450 on each opening 438 is that the length of each relief slit 450 can be shortened with respect to the embodiments discussed above. For example, the preferred ratio of slit length to aperture diameter can be about 1:13.

As illustrated in FIGS. 1-6, the sleeve 100 includes three openings 138, 238, 338, 438 in the bottom panel 128, 228, 328, 428 thereof, however, the sleeve 100 could alternatively include one, two, or more than three openings. The sleeve 100 also is shown as containing two stacked rows of containers 101, however, the sleeve 100 could also contain a single row of containers, two rows in side-by-side orientation with associated openings, or side-by-side rows with stacked rows positioned above, or the like.

So configured, a bottom row 156 of the containers 101 can be loaded into the openings 138, 238, 338, 428 of the blank 102 such that the flanges 136 of the containers 101 rest on the bottom panel 128, 228, 328, 428 of the sleeve. A top row 158 of the containers 101 is stacked on top of the bottom row 156. The panels 110 of the blank 102 can then pivoted or rotated about the fold lines 112 to form the sleeve 100 into a generally box shape, as shown in FIG. 2. The first top panel 116 can be secured to the second top panel 118 by any suitable mechanism, such as adhering a bottom surface 160 of the first top panel 116 to a top surface 162 of the second top panel 118, sealing, tongue-and-groove, or the like. So stored, the sleeve 100 and the containers 101 can be transported and/or offered for sale.

One of the containers 101 in the bottom row 156 can then subsequently be removed through the bottom panel 128, 228, 328, 428 without compromising the structural integrity of the sleeve 100 and/or preserving a support structure sufficient to support the flange of a subsequent container 101 received in the opening 138, 238, 338, 438. This can be accomplished such as by gripping the sidewall 142 of the container 101 and pulling generally downward with respect to the sleeve 100. If present, the bridges 154 connecting the relief slits 150, 250, 350, 450 to the openings 138, 238, 338, 438 can then break and the relief slits 150, 250, 350, 450 can separate to accommodate the diameter or width D2 of the container 101. Advantageously, removal of the container 101 does not compromise the supporting ability of the bottom panel 128, 228, 328, 428, such that if one of the containers 101 is subsequently received in the openings 138, 238, 338, 438, for example when the container 101 in the top row 158 stacked on the recently removed container 101 drops down with the cup's 101 sidewall passing through the opening 138, 238, 338, 438, the bottom panel 128, 228, 328, 428 can still support the flange 136 thereon.

The containers 101 are preferably composed of plastics, such as food grade plastics, or other suitable materials for contents of the containers 101, which can include food items, including, for example, gelatin, pudding, vegetables, fruit, or other desserts. In one form, the flange 136 extends outward from the sidewall 142 in a direction generally parallel to the base 140. The flange 136 can take any suitable outer shape, such as generally square with or without rounded corners, rectangular, circular, oval, or the like. Although the flange 136 is discussed herein, other enlarged portions of the container 101 can alternatively be used for retention.

As illustrated in FIGS. 2 and 3, the sleeve may be constructed from a foldable blank 102, such as of paperboard, cardboard, cardstock, plastic or the like. Preferably, the sleeve 100 is constructed from a single blank of material, but it can also be constructed from multiple segments of material if desired. As illustrated in the exemplary embodiment, the blank 102 is generally rectangular with top and bottom edges 104, 106 connected by side edges 108. The blank 102 is divided into a series of five panels 110 extending transversely across the blank 102 between the side edges 108. The panels 110 are connected intermediate of the top and bottom edges 104, 106 by the fold lines 112, which also extend generally transversely between the side edges 108.

The top surface 114 of the sleeve 100 is divided into two panels, a first top panel 116 and a second top panel 118, positioned on opposite ends of the blank 102. Specifically, the first top panel 116 is generally rectangular and positioned adjacent the top edge 104 of the blank 102 and the second top panel 118 is generally rectangular and positioned adjacent the bottom edge 106 of the blank 102. The back panel 120 lies adjacent the first top panel 114, connected to the first top panel 114 by a fold line 122. Similarly, the front panel 124 lies adjacent the second top panel 116, connected to the second top panel 116 by a fold line 126. As illustrated, the bottom panel 128 is centrally positioned among the five panels 110 and connects to the front panel 124 and the back panel 120 by fold lines 130 on its side edges. Other combinations and/or locations of panels could also be utilized to form the sleeve 100, as desired.

In one form, the fold line 126 connecting the second top panel 118 and the front panel 124 includes slot segments 132, which define tabs 134. The tab segments 130 may include any suitable combination of scores, cuts, perforations, or the like, so that when the second top panel 118 and the front panel 124 are pivoted with respect to each other, the tab segments 132 are configured to break so that the tabs 134 generally pivot along with the second top panel 118 to a positioned generally transverse to the front panel 124. This creates slots 135 in the front panel 124 that are configured to partially receive the flange 136 and specifically the tab 145 from the containers 101 in the top row 158 to retain the containers 101 in the sleeve 100. Alternatively, or in the event that folding the sleeve 100 does not break the slot segments 132, the slot segments 132 can be broken by the flange 136 or tab 145 of the containers 101.

The drawings and foregoing descriptions are not intended to represent the only forms of the separable raised platform in regards to the details of construction. Changes in form and in proportion of parts, as well as the substitution of equivalents, are contemplated as circumstances may suggest or render expedient.

The invention claimed is:

1. A multi-panel sleeve for storing and dispensing a plurality of containers having an outwardly extending upper flange, the multi-panel sleeve comprising:

a bottom panel, a pair of side panels each connected to a longitudinal side edge of the bottom panel, and a top panel extending between the pair of side panels, the bottom panel having a longitudinal center axis;

at least two openings defined by the bottom panel and spaced from the longitudinal side edges of the bottom panel, wherein each of the openings is in a single row and the openings each have a first size smaller than an upper flange of a container to permit a received container to extend partially through one of the openings so that the upper flange thereof is supported by the bottom panel; and at least two slits positioned adjacent to each of the openings, a first of an adjacent pair of the openings having more slits on a first side of the longitudinal center axis than an opposite second side and a second of the adjacent pair of the openings having more slits on the second side of the longitudinal center axis than the first side, the slits extending generally outward from each of the openings while also being spaced from the longitudinal side edges of the bottom panel, wherein the slits are configured to allow the openings to increase to a second size to permit the upper flange of the received container to pass through a respective opening for removal thereof from the sleeve and to at least partially return to the first size whereby an upper flange of a subsequent received container is supported by the bottom panel.

2. The sleeve of claim 1 wherein the slits each terminate at or prior to crossing an imaginary line tangent to an outer periphery of each of the openings and parallel to one of the longitudinal side edges of the bottom panel.

3. The sleeve of claim 1 wherein the openings comprise at least three openings each having the slits extending radially therefrom and configured so that the slits of adjacent openings are disposed on an opposite sides of the bottom panel, with the other side of the bottom panel of each opening being free of slits.

4. The sleeve of claim 1 wherein a ratio of slit length to a diameter of the openings are between about 1 to 13 and 1 to 6.5.

5. The sleeve of claim 1 wherein the at least two slits each have lengths of about 0.375 inches.

6. The sleeve of claim 1 further comprising at least two bridges spacing each of the slits from each of the openings, the bridges configured to remain intact until subsequent removal of the received container through the respective opening.

7. The sleeve of claim 6 wherein a midpoint between the slits on an edge of each of the openings is closest to an adjacent one of the longitudinal side edges of the bottom panel.

8. The sleeve of claim 1 wherein the sleeve is configured to contain two rows containers in a stacked orientation.

9. The sleeve of claim 1 wherein the slits are spaced apart around each of the openings within a range of between about 35 degrees and about 145 degrees.

10. The sleeve of claim 1 wherein the pair of openings having centers that are offset by different distances from the longitudinal center axis.

11. The sleeve of claim 1 wherein the openings are generally circular and wherein the slits are spaced about 180 degrees or less from one another adjacent to each of the openings.

12. The sleeve of claim 1 wherein the at least two slits comprises three slits spaced equidistant around the pair of openings.

13. A method of forming a multi-panel sleeve configured to store and permit selective removal of containers having an outwardly extending upper flange, the method comprising:

providing a bottom panel, a pair of side panels each connected to a longitudinal side edge of the bottom panel, and a top panel extending between the pair of side panels;

forming a single row of at least two openings of a first size smaller than an upper flange of a container in the bottom panel spaced from the longitudinal side edges, so that a received container is permitted to extend partially through the opening while an upper flange thereof is supported by the bottom panel;

forming at least two slits starting adjacent each of the openings, a first of an adjacent pair of the openings having more slits on a first side of a longitudinal center axis of the bottom panel than an opposite second side and a second of the adjacent pair of the openings having more slits on the second side of the longitudinal center axis than the first side, the slits extending generally outward from each opening to a position spaced from the longitudinal side edges, wherein the slits are configured to allow each of the openings to increase to a second size to permit the upper flange of the received container to pass therethrough for removal of the received container from the sleeve and to at least partially return to the first size whereby an upper flange of a subsequent received container is supported by the bottom panel.

14. The method of claim 13 wherein the step of forming the openings comprises forming at least two generally circular openings and wherein the step of forming the slits comprises forming at least two slits spaced about 180 degrees or less from each other.

15. The method of claim 13 wherein the step of forming the openings comprises forming a single row of three or more openings and wherein the step of forming the slits adjacent to each of the openings comprises forming at least two slits adjacent to each of the openings on alternating sides thereof with the other sides being free of slits.

16. The method of claim 13 wherein the step of forming the slits adjacent to each of the openings comprises forming two slits adjacent to each of the openings so that a midpoint along an edge of each of the openings between the two slits is the respective opening's closest point to an adjacent bottom panel longitudinal side edge.

17. The method of claim 13 in combination with loading a plurality of containers, the method further comprising:

positioning a bottom row of the plurality of containers within the openings so that upper flanges of the bottom row at least partially rests on the bottom panel and the slits;

positioning a top row of the plurality of containers on top of the bottom row;

enclosing the plurality of containers within the sleeve by manipulating the side panels to be positioned adjacent sides of the top and bottom rows and the top panel to be positioned adjacent upper flanges of the top row.

* * * * *

UNITED STATES PATENT AND TRADEMARK OFFICE

CERTIFICATE OF CORRECTION

PATENT NO. : 8,061,519 B2
APPLICATION NO. : 12/716807
DATED : November 22, 2011
INVENTOR(S) : Taglione It is certified that error appears in the above-identified patent and that said Letters Patent is hereby corrected as shown below:

- In Column 7, Line 27, in Claim 3, delete “panel,” and insert -- panel --.

- In Column 7, Line 45, in Claim 8, delete “rows” and insert -- rows of --.

Signed and Sealed this
Twenty-seventh Day of March, 2012

David J. Kappos

David J. Kappos
*Director of the United States Patent and Trademark Office*